US005476036A

United States Patent [19]

Liebing

[11] Patent Number: 5,476,036

[45] Date of Patent: Dec. 19, 1995

[54] ABRADING OR POLISHING MACHINE

[75] Inventor: Stefan Liebing, Braunschweig, Germany

[73] Assignee: Bühler GmbH, Braunschweig, Germany

[21] Appl. No.: 316,773

[22] Filed: Oct. 3, 1994

[30] Foreign Application Priority Data

Oct. 2, 1993 [DE] Germany ..... 43 33 703.1

[51] Int. Cl.[6] ..... B02B 3/00; B02B 3/04; B02B 3/06

[52] U.S. Cl. ..... 99/519; 99/524; 99/606; 99/609; 99/611

[58] Field of Search ..... 99/518–525, 528, 99/600–611, 612–615, 619, 617, 620, 622; 426/481–483; 241/86.1, 88.2, 93; 51/4, 22, 72 R

[56] References Cited

U.S. PATENT DOCUMENTS

| | | | |
|---|---|---|---|
| 1,100,190 | 6/1914 | Lund et al. | 99/606 |
| 1,525,398 | 2/1925 | Kemp | 99/607 |
| 3,734,752 | 5/1973 | Headley | 99/519 |
| 3,960,068 | 6/1976 | Salete | 99/606 |
| 4,292,890 | 10/1981 | Salete-Garces | 99/603 |
| 4,426,921 | 1/1984 | Meinardus | 99/519 |
| 4,459,903 | 7/1984 | Yamamoto | 99/524 |
| 4,515,075 | 5/1985 | Satake | 99/611 |
| 4,583,455 | 4/1986 | Salete-Garces | 99/617 |
| 5,259,303 | 11/1993 | Yamamoto et al. | 99/611 |

*Primary Examiner*—Timothy F. Simone
*Attorney, Agent, or Firm*—Martin A. Farber

[57] ABSTRACT

A screen assembly for grain husking, decorticating, polishing and whitening machines, the assembly to be mounted on a frame part of the respective machine. The assembly comprises at least two screen sectors which form a substantially cylindrical shape around a longitudinal axis in assembled condition. A frame is provided for each of the screen sectors for framing and supporting the screen sectors by reinforcing the circumference of the screen sectors. An axle arrangement on at least one of the frames extends substantially parallel to the longitudinal axis and is provided for adjusting the distance between the longitudinal axis and a respective one of the screen sectors and one circumferential side of the screen sectors. The axle arrangement comprises a first and second axle parallel to each other within the range of two adjacent circumferential sides of two adjacent screen sectors. A pitman rod connects the axles.

10 Claims, 1 Drawing Sheet

ABRADING OR POLISHING MACHINE

FIELD AND BACKGROUND OF THE INVENTION

The invention relates to an abrading and/or polishing machine for cereals, such as rice or other grain varieties, comprising an abrading and or polishing rotor enclosed by a screen which consists of a plurality of screen sectors radially adjustable, which screen sectors are pivotably mounted at one respective end about a link axis.

Conventional abrading or polishing machines, in particular abrading machines, comprise an arrangement of screen sectors mounted at one circumferential end at a link axis, whereas the second circumferential end is pivotable about that axis in such a manner that it projects more or less into the space of the cereals to be treated. The purpose of this arrangement is to provide an increased resistance for the cereals carried away by the rotor toward the free end of the screen sector by an adjustment radially inwardly so that a rubbing effect is caused between the rotor and the cereals, or between the cereals, respectively. If no such resistance were to be provided, but with the screen housing being designed concentrically and circular cylindrically, the grains would be driven by the rotor to an idle circumferential motion all around the inner side of the screen, without an abrasion of husk rests and the like being produced.

When using the term "cereals" in the present patent specification, there can be meant the most diverse cereals. In general, such a treatment is carried out with rice, but at times also with other grain varieties. Furthermore, the application of such machines has already been suggested also for coffee beans.

In the design described above, axially extending flanges are located at the ends of the screen sectors, which flanges are to provide a covering when the free end of the screen sector is adjusted in radical direction, since otherwise a gap would open between the free end of the one screen sector and the linked end of the adjoining screen sector, through which gap the granular material may pass through. It is true that a complete covering will not be possible for mere geometrical reason, for in the case of a pivoting motion of one screen sector with respect to the other one, the angle of the flange relative to a radial plane extending across the link axis of the adjoining screen sector will naturally also be changed. In the case of cereals of a lower size and/or larger setting ranges, this may have the effect that a gap in between adjacent screen sector may develop, through wdhich the cereals will exit. This disadvantage also made it an essential requirement to limit the setting range of the screen sectors with the known constructions, i.e. to keep it smaller under certain conditions than would convenient.

Another drawback of the known design is caused by the fact that each single one of the primarily three, screen sectdors had to be adjusted separately, which was time consuming and led to down-times, for this work could be carried out only during times of stand-stills of the machine aftr the operator had gained acess to the screen accommodated in a housing.

SUMMARY OF THE INVENTION

It is an object of the invention to improve the known construction while avoiding the disadvantages described. This is effected in accordance wdith the invention by pivoting each screen sector also at its other end about a link axis and by providing the support of adjacent screen sector on a common pitman rod briding an axial gap between two respective adjoining screen sectors. Thus, in contrast to the known construction, the two circumferential ends of each screen sector are freely movable within certain limits, in which case, due to the arrangement of the pitman rods, the movement approximately corresponds to a parallel displacement, so that—irrespective of the length of the setting range for the screen sector—the distance of one screen sector from the adjacent screen sector constantly remains substantially the same, wdhereby gap opening through which the cereals might pass will be avoided.

Furthermore, a surprising and very essential effect will be produced that the movement of even one single screen sector caused by the pitman rod will automatically bring about the corresponding positioning of all the other screen sectors.

According to a preferred embodiment of the invention, each pitman rod is arranged pivotably about an articulated This provides the advantage of very safe cinematics along with reliable function.

The preferred embodiment of the invention is particularly advantageous wherein each pitman rod is designed as a two-armed lever and each arm of the lever is equipped with a pitman rod axis for the support of a screen sector. By choosing this arrangement there is effected a precise guidance for the positioning of the screen sectors, which ensures a reliable operation of the machine over long operating times.

According to a further preferred embodiment of the invention the two-armed lever forming the pitman rod is formed symmetrically. Thereby there will be achieved identical setting ranges or identical adjustments for all screen sectors.

If according to a preferred embodiment of the invention at least one screen sector is provided with an adjustment device for the radial positioning with respect to the abrading and/or polishing rotor, all screen sectors will be positioned in an advantageous manner this embodiment by the invention. The adjustment device will be particularly simple but very efficient if according to a further preferred embodiment of the invention it is formed by a stationarily mounted adjustment lever which is linked to a pitman rod or to an arm of the lever of the pitman rod by means of a push rod, with the adjustment lever or the appertaining pitman rod preferably comprising a fastening device.

BRIEF DESCRIPTION OF THE DRAWING

With the above and other objects and advantages in view, the present invention will become more clearly understood in connection with a detailed description of preferred embodiments, when considered with the accompanying drawing, of which:

FIG. 1 shows a longitudinal section across a polishing machine provided by the invention, for which

DETAILED DESCRIPTION OF THE PREFERRED EMBODIMENTS

Figure 1:
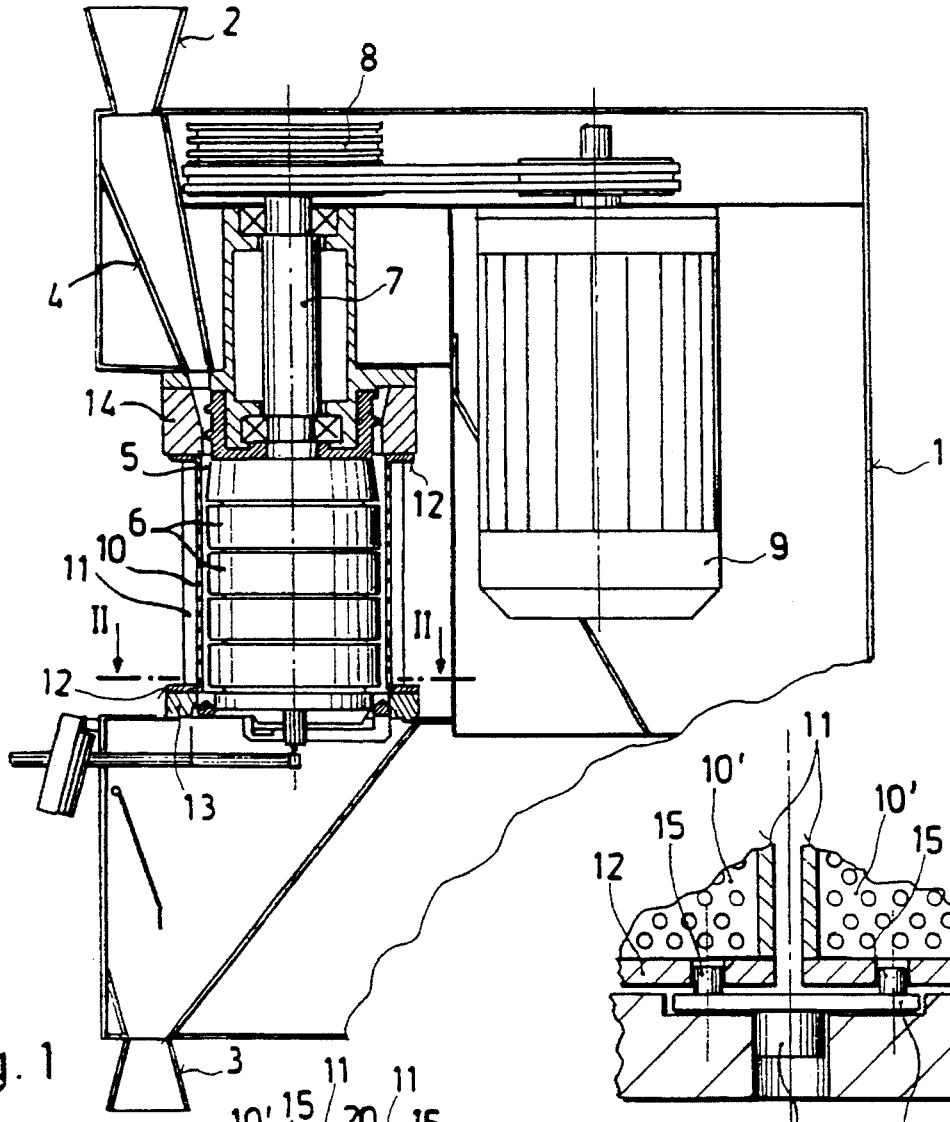

A polishing machine schematically represented in FIG. 1 in a longitudinal section comprises a machine housing 1, on whose upper side there is arranged a feed hopper 2 for the granular material to be treated, with the material being discharged on the bottom side via a hopper, or a tube 3 after the treatment. Following the feed hopper 2, there is located a charging chute 4, through which the granular material to be treated is introduced into a ring-slot-shaped treating chamber 5. Within the treating chamber 5 there is situated a polishing rotor 6 which is arranged at a shaft 7 and is drivable via a pulley by a motor 9.

Figure 2:
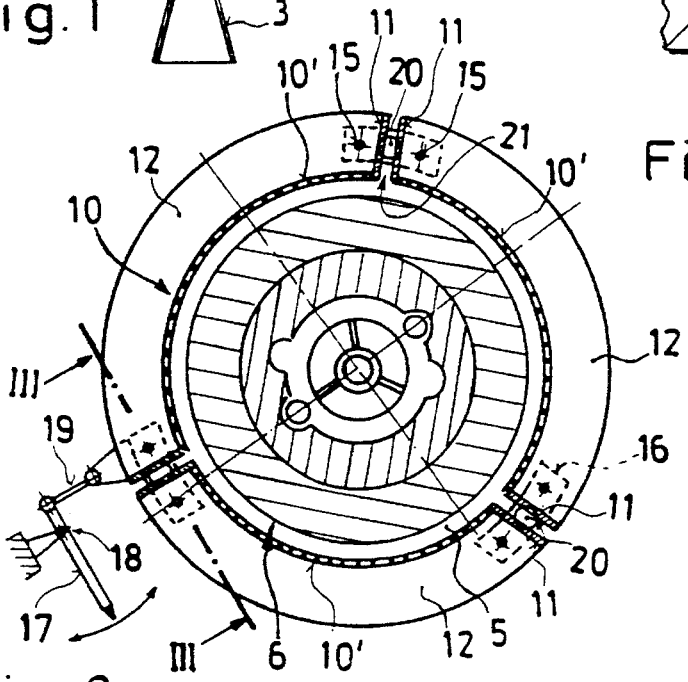
FIG. 2 represents a cross-section along the line II—II of FIG. 1.

On its circumference, the treating chamber 5 is defined by a screen 10 which, according to FIG. 2, is made up of three screen sectors 10' movable relative to each other. At their ends, the screen sectors 10' have flanges 11 extending across the axial length of the treating chamber 5, which flanges 11 are termed "axial flanges" hereinafter. As can be seen in FIG. 1, a flange 12 is provided respectively extending radially outwardly from the upper and lower part of the screen 10 in an annular manner, which flange 12 is fastened to a toroid-shaped base plate 13 (on the bottom side) as well as to a toroid body 14 on the upper side in a manner to be described hereinafter.

It is to be understood that the holes of the screen 10 are conventionally small enough to retain the granular material to be treated in the treating chamber 5, so that merely the abraded particles may move outwardly. From FIG. 2 it also becomes apparent that the radial flange 12 consists of three parts respectively corresponding to the screen sectors 10' and being connected thereto.

The known design was provided in such a manner that at one circumferential end of each screen sector 10' or at its appertaining radial flange 12, a link axle 15 was rigidly connected to the plate 13 lying therebelow, whereas the other circumferential end of the screen sector was freely movable, adjoining that end of the adjacent screen sector 10' which in turn was linked to a fixed axis. If the free ends of the screen sectors 10' were moved radially inwardly and outwardly, gaps were caused between adjacent screen sectors 10' due to the pivoting motion, through which gaps the granular material could to escape. Furthermore, each screen sector had to be adjusted separately.

This disadvantage is avoided according to the invention by respectively interconnecting the screen sectors 10' via pitman rods 16, which are movably Connected to the screen sector 10' or its radial flange 12 via respective axles 15. In this way there will result merely a parallel displacement between adjacent axial flanges 11, that is, the gap 21 lying therebetween will change only minimally in radial direction with respect to the treating chamber 5 if the screen sectors 10' are moved.

A further advantage is provided by the fact that the pitman rods 16 are able to transmit the movement of a screen sector 10' or its appertaining radial flange 12 directly to the other screen sectors. For this reason, it will be sufficient if a single adjustment lever 17 can be operated from outside the housing 1. The adjustment lever 17 is located at a pivot 18 represented merely schematically, actuating a push rod 19 via its short opposite end, which push rod 19 determines the axial position of the radial flange 12 and its appertaining screen sector 10'. When choosing this arrangement, it will be convenient to assign a corresponding locking device (not represented) to the lever 17 and to have it engage a sliding block movable along an adjusting screw spindle, with the screw spindle effecting the locking due to its self-locking effect.

Figure 3:
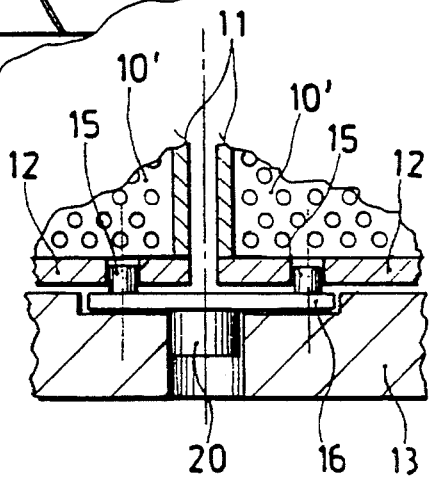
FIG. 3 illustrates an enlarged section along the line III—III of FIG. 2.

It would actually be possible to have the pitman rod 16 take its effect solely also for the securing of the screen 10 with respect to the rotor 6, if only there is provided any arrangement for the pitman rod leading to a defined pivoting motion thereof. Such an arrangement defining a pivoting axis could be realized in various manners, for example by arranging a rubbing surface designed centrally (it could also be eccentrically) between the ends of the pitman rods at the pitman rod and/or at its adjacent housing surface. However, more secure cinematics and a better function will be achieved if the pitman rod itself is pivotable about an articulated axis 20 particularly apparent from FIG. 3. This articulated axis 20 is conveniently provided in the center of each pitman rod 16, so that each pitman rod 16 forms practically a two-armed lever with its axles 15.

What is claimed is:

1. A screen assembly for grain husking, decorticating, polishing and whitening machines, said assembly comprising at least two screen sectors forming in cooperation a substantially cylindrical shape around a longitudinal axis thereof, each of said screen sectors defining a circumference;

frame means for each of said screen sectors for framing and supporting said sectors by reinforcing said circumference of said screen sectors;

an axle arrangement on at least one of said frame means and extending substantially parallel to said longitudinal axis for adjusting distance between said longitudinal axis and a respective one of said screen sectors and one circumferential side of said screen sectors, said axle arrangement comprising first and second axle forming means parallel to each other within range of two adjacent circumferential sides of two adjacent screen sectors, and pitman rod means connecting said axle forming means.

2. An assembly according to claim 1, wherein said axle arrangement further comprises an intermediate axle forming means intermediate said first and second axle forming means and being stationarily mounted so as to enable the pitman rod means to pivot about a defined pivot axis.

3. An assembly as claimed in claim 2, wherein said pitman rod means is symmetric and of equal length from said intermediate axle forming means to each of said first and second axle forming means.

4. An assembly as claimed in claim 1, wherein said at least two screen sectors are interconnected by a respective number of said pitman rod means.

5. An assembly as claimed in claim 1, further comprising adjusting means for adjusting and fixing the position of at least one of said screen sectors.

6. An assembly as claimed in claim 5, wherein said adjusting means are connected to at least two of said screen sectors for simultaneous adjustment.

7. An assembly as claimed in claim 5, wherein said adjusting means comprise lever means pivotable about a stationary pivoting axis and being connected to at least one of said pitman rod means.

8. An assembly as claimed in claim 7, wherein said adjusting means further comprise push rod means for connecting said lever means and said pitman rod means.

9. An assembly as claimed in claim 7, wherein said lever means are connected to one end of said pitman rod means.

10. An assembly as claimed in claim 5, wherein said adjusting means further comprise fixing means for fixing the respective adjusted position of said at least one of said screen sectors.

* * * * *